US006766934B2

(12) United States Patent
Ziegelaar et al.

(10) Patent No.: US 6,766,934 B2
(45) Date of Patent: Jul. 27, 2004

(54) METHOD AND APPARATUS FOR STEERING STRIP MATERIAL

(75) Inventors: John Albert Ziegelaar, Farmborough Heights (AU); Brett Gray, Brownsburg, IN (US); Hiroaki Kuwano, Yokosuka (JP)

(73) Assignee: Castrip, LLC, Charlotte, NC (US)

( * ) Notice: Subject to any disclaimer, the term of this patent is extended or adjusted under 35 U.S.C. 154(b) by 0 days.

(21) Appl. No.: 10/203,152

(22) PCT Filed: Jan. 31, 2001

(86) PCT No.: PCT/AU01/00086

§ 371 (c)(1),
(2), (4) Date: Aug. 6, 2002

(87) PCT Pub. No.: WO01/58612

PCT Pub. Date: Aug. 16, 2001

(65) Prior Publication Data

US 2003/0014163 A1 Jan. 16, 2003

(30) Foreign Application Priority Data

Feb. 7, 2000 (AU) ..... PQ5469

(51) Int. Cl.[7] ..... B65H 26/00; B65H 43/08
(52) U.S. Cl. ..... 226/21; 72/234
(58) Field of Search ..... 226/21; 72/9.3, 72/11.5, 11.9, 8.7, 234

(56) References Cited

U.S. PATENT DOCUMENTS 3,422,649 A * 1/1969 Lowy ..... 226/21
3,491,562 A * 1/1970 Kajiwara ..... 226/21
4,086,689 A * 5/1978 Martt ..... 226/21
4,570,472 A * 2/1986 Kuwano ..... 72/8.4
4,700,312 A * 10/1987 Kikuma et al. ..... 72/10.4
5,503,217 A * 4/1996 Perry et al. ..... 164/454
5,629,030 A * 5/1997 Beringer et al. ..... 425/135

FOREIGN PATENT DOCUMENTS

| | | |
|---|---|---|
| EP | 903187 A2 | 3/1999 |
| GB | 2 100 475 | 12/1982 |
| JP | 57-112919 | 7/1982 |
| JP | 59-085314 | 5/1984 |
| JP | 59-118216 | 7/1984 |
| JP | 07124625 A | 5/1995 |
| JP | 07-198369 A | 8/1995 |
| JP | 08318304 A | 12/1996 |
| JP | 10034220 A | 2/1998 |
| JP | 10085818 A | 4/1998 |
| TW | 333477 | 6/1998 |

* cited by examiner

*Primary Examiner*—Emmanuel Marcelo
(74) *Attorney, Agent, or Firm*—Barnes & Thornburg

(57) ABSTRACT

Strip material is fed to a reduction rolling mill by a steering device in the form of a pinch roll stand comprising pinch rolls to which strip gripping forces are applied by hydraulic cylinder units located at the ends of the pinch rolls. A reduction mill is similarly provided with a pair of hydraulic cylinder units which are independently operable to vary the pressure applied by the reduction rolls across the strip. Sensors sense the position of the strip at a first location in advance of the pinch rolls and a second location in advance of the rolling mill. This output of sensors is fed to a controller which controls operation of both sets of hydraulic cylinder units to steer the strip.

19 Claims, 5 Drawing Sheets

METHOD AND APPARATUS FOR STEERING STRIP MATERIAL

CROSS-REFERENCE TO RELATED APPLICATIONS

A This application is a U.S. national counterpart application of international application serial no. PCT/AU01/00086 filed Jan. 31, 2001, which claims priority to Australian application serial No. PQ 5469 filed Feb. 7, 2000.

BACKGROUND AND SUMMARY OF THE INVENTION

Technical Field

This invention relates to the rolling of strip material. It has particular, but not exclusive, application to hot rolling of steel strip produced from a continuous caster such as a twin roll caster.

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of vessels from which it flows through a metal delivery nozzle located above the nip so as to direct it into the nip between the rolls, so forming a casting pool of molten metal supported on the casting surfaces of the rolls immediately above the nip. This casting pool may be confined between side plates or dams held in sliding engagement with the ends of the rolls.

After leaving the caster the hot strip may be subjected to in-line treatment such as a controlled temperature reduction, reduction rolling, full heat treatment or a combination of such treatment steps before passing to a coiler. The coiler and any in-line treatment apparatus generally applies substantial tension to the strip which must be resisted. Moreover, it is necessary to accommodate differences between the casting speed of the twin roll caster and speed of subsequent in-line processing and coiling. Substantial differences in those speeds may develop particularly during initial start-up and until steady state casting speed is achieved. In order to meet these requirements it has been proposed to allow the hot strip leaving the caster to hang unhindered in a loop from which it passes through one or more sets of pinch rolls into a tensioned part of the line in which the strip is subjected to further processing and coiling. The pinch rolls provide resistance to the tension generated by the down-line equipment and are also intended to feed the strip into the down-line equipment.

A twin roll strip casting line of this kind is disclosed in U.S. Pat. No. 5,503,217 assigned to Davy McKee (Sheffield) Limited. In this casting line the hot metal strip hangs unhindered in a loop before passing to a first set of pinch rolls which feed the strip though a temperature control zone. After passing through the temperature control zone the strip passes through further sets of pinch rolls before proceeding to a coiler. It may optionally be hot rolled by inclusion of a rolling mill between the subsequent sets of pinch rolls.

As noted in U.S. Pat. No. 5,503,217, strip passing from zero tension to a tension part of a processing line can wander from side to side. This is not acceptable and is overcome by the first set of pinch rolls being used to steer the metal strip into the tensioned part of the processing line. However, it has been found that standard pinch rolls are not properly effective to steer the strip and hold it against the tendency to wander. The pinch rolls can in fact contribute to misalignment and lateral movement of the strip if even small variations develop in the strip to roll contact pressure, the gap between the pinch rolls, or in the profile or cross-section of the cast strip passing between them.

Wandering of the strip not only results in misalignment of the strip in the down-line processing equipment, but it can also lead to the transmission of twisting forces back into the hot strip issuing from the casting rolls. This twisting is particularly critical given the strip is at temperatures close to liquidus and thus the strip has little hot strength. In ferrous metal strip these temperatures are well in excess of 1100° C. Thus such twisting can lead to hot lateral tearing of the strip just below the roll nip. In addition, the generation of substantial fluctuations in the tensile forces at the edge margins of the strip leads to waviness in the strip margins and the generation of small edge cracks as the strip approaches the pinch rolls. In extreme cases it can even initiate severe lateral mechanical cracking and complete disruption of the strip. Accordingly, wandering of the strip in advance of the pinch rolls is a critical problem, particularly in the casting of ferrous metal strip. Our earlier Australian Patent Application 84245/98 describes apparatus which can be applied to the steering of the strip in these circumstances to prevent excessive wandering and skewing of the strip. In that case the pinch rolls are operated to grip the strip with varying intensity across the strip to steer the strip in accordance with a control signal generated by monitoring the position of the strip in the vicinity of the pinch rolls to detect changes in lateral position of the strip and the lateral traversing velocity of skew of the strip.

The arrangement disclosed in Patent Application 84245/98 is quite satisfactory for feeding strip into most in-line treatment apparatus. However, it has been found on feeding a strip through an in-line hot rolling mill that the rolling mill itself can generate lateral movements of the strip and/or tension disturbances which can under some conditions overcome the steering control provided by the pinch rolls. The present invention provides a method and apparatus by which a strip passing between reduction rolls can be accurately steered so as to be maintained in a substantially steady straight line path. Although the invention has arisen from the need to control strip issuing from a twin roll caster into an in-line rolling mill, it could be applied in other applications where strip material is to be passed through a reduction mill.

According to the invention, there is provided a method of rolling strip material comprising passing the strip through a steering device into a rolling mill having a pair of strip reduction rolls extending laterally of the strip feed direction, the steering device being operable to steer the strip as it passes to the rolling mill, applying strip reduction squeezing forces to the reduction rolls at positions spaced apart longitudinally of those rolls, monitoring the position of the strip at a first location in the vicinity of the steering device and at a second location in the vicinity of the rolling mill, and operating the steering device and varying the relative squeezing forces on the reduction rolls at the spaced positions in response to observed positions of the strip at said first and second locations.

The steering device may comprise a pair of pinch rolls extending laterally of the strip feed direction. In that case the method may comprise passing the strip between those pinch rolls, applying strip gripping forces to the pinch rolls at positions spaced apart along the pinch rolls, and varying the relative strip gripping forces applied at said positions along the pinch rolls thereby to steer the strip. Alternatively, the pinch rolls may be moved relative to one another or they may be moved laterally of the feed direction of the strip to produce the requisite steering action.

The steering device may be operated in response to a control signal produced by comparing an observed strip position at said first location with a desired or set position. Variation of the relative squeezing forces applied to the reduction rolls may be controlled by a further control signal dependent on observed strip positions at both first and second locations when compared with desired or set positions for those locations to effect a change in the strip position and/or skew of the strip.

Said first location may be in advance of the steering device in relation to the strip feed direction and said second location may be in advance of the reduction rolls.

The invention also provides an apparatus for rolling strip material, having

- a pair of reduction rolls to receive the strip material;
- a roll thruster to apply squeezing forces to the reduction rolls at positions spaced apart along those rolls;
- a strip steering device to steer the strip to the reduction rolls and operable to vary the feed direction;
- a first strip position sensor to monitor the position of the strip at a first location in the vicinity of the strip steering device;
- a second strip position sensor to monitor the position of the strip at a second location in the vicinity of the reduction rolls; and
- a controller responsive to outputs of the first and second strip position sensors to operate the steering device to vary the direction of feed to the reduction rolls and also to vary the relative squeezing forces applied to the reduction rolls at the spaced apart positions.

The relative squeezing forces applied to the reduction rolls at the spaced apart positions may vary the position and skew of the strip entering the reduction rolls.

The first and second sensors may each consist of a plurality of individual sensors.

BRIEF DESCRIPTION OF THE DRAWINGS

In order that the invention may be more fully explained, one particular embodiment will be described in detail with reference to the accompanying drawings in which.

DETAILED DESCRIPTION OF THE DRAWINGS

Figure 1:
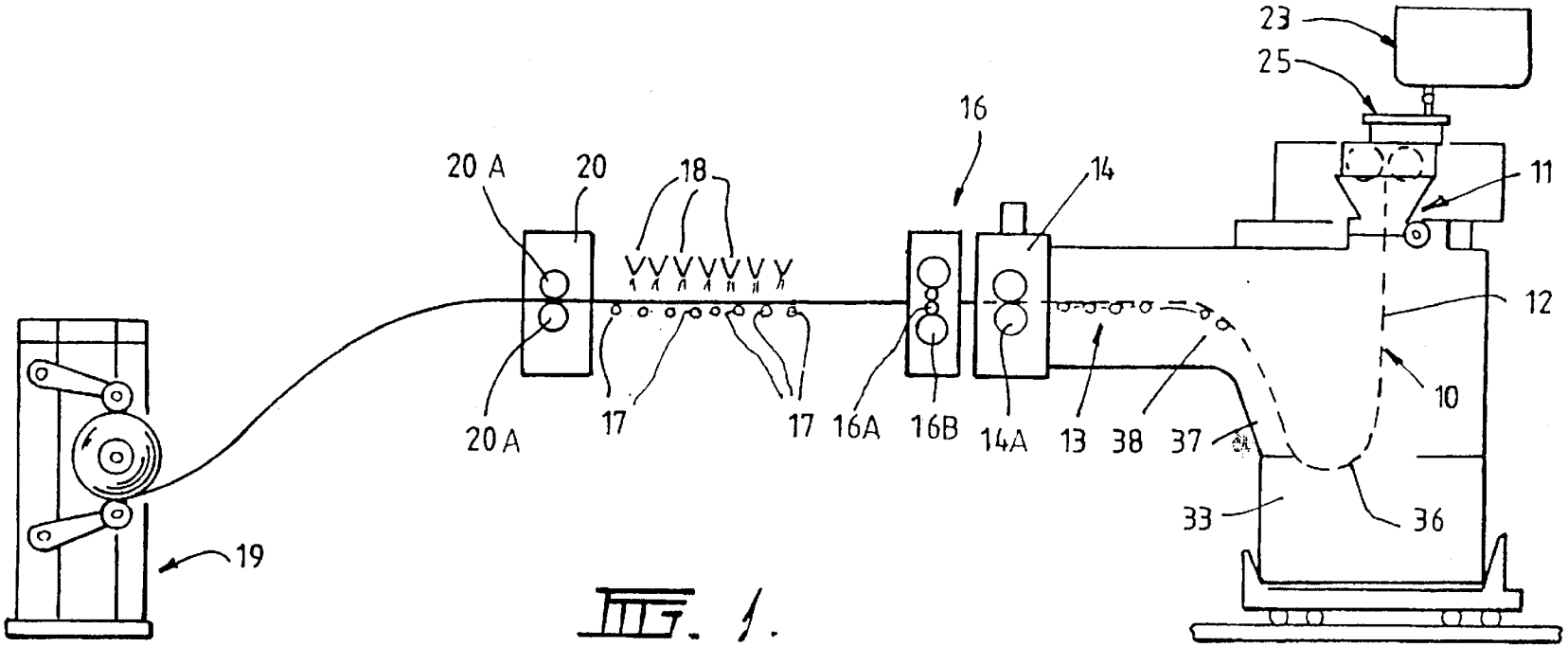
FIG. 1 illustrates a strip casting installation incorporating an in-line rolling mill and steering system in accordance with the invention.
Figure 2:
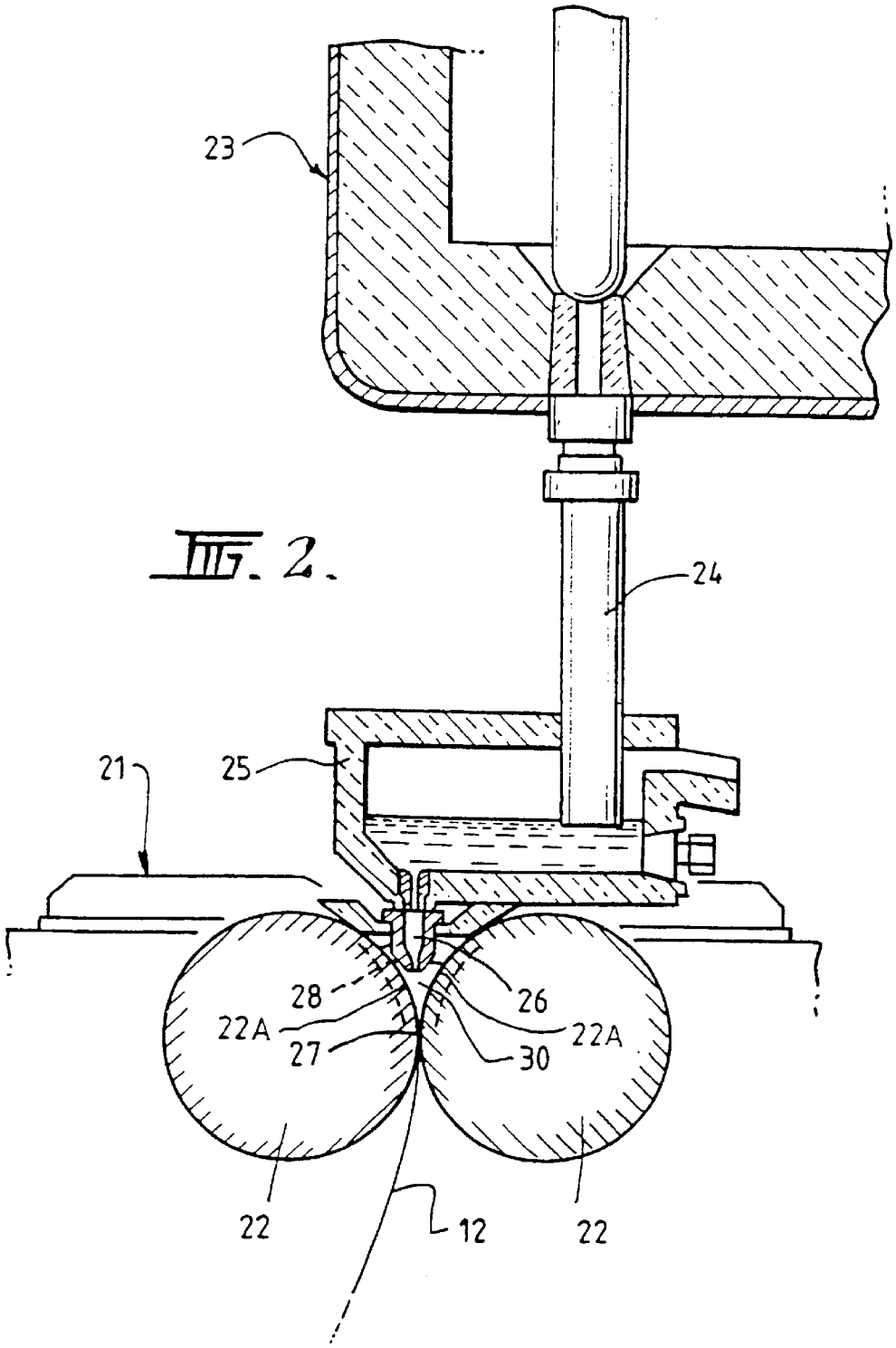
FIG. 2 illustrates essential components of the twin roll caster.
Figure 3:
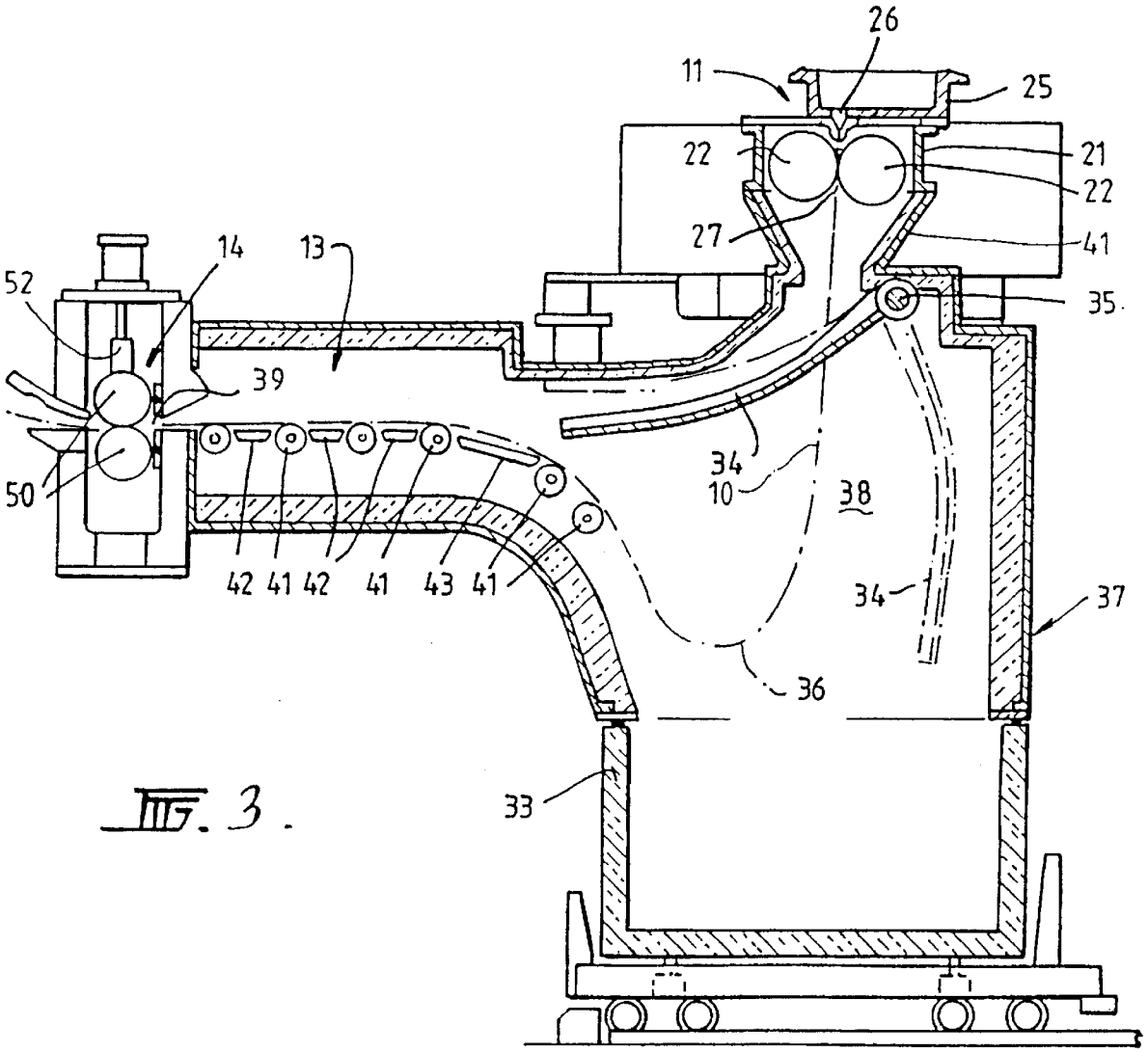
FIG. 3 illustrates the manner in which cast strip produced by the caster is fed in a loop to a set of pinch rolls which are operated to steer the strip to the in-line rolling mill.

The illustrated casting and rolling installation comprises a twin roll caster denoted generally as 11 which produces a cast steel strip 12 which passes in a transit path 10 across a guide table 13 to a pinch roll stand 14 comprising pinch rolls 50. Immediately after exiting the pinch roll stand 14, the strip passes into a hot rolling mill 16 comprising a pair of reduction rolls 16A and supporting rolls 16B by in which it is hot rolled to reduce its thickness. The rolled strip passes onto a run-out table 17 on which it may be force cooled by water jets 18 and through a pinch roll stand 20 comprising a pair of pinch rolls 20A, and thence to a coiler 19.

Twin roll caster 11 comprises a main machine frame 21 which supports a pair of parallel casting rolls 22 having casting surfaces 22A. Molten metal is supplied during a casting operation from a ladle (not shown) to a tundish 23, through a refractory shroud 24 to a distributor 25 and thence through a metal delivery nozzle 26 into the nip 27 between the casting rolls 22. Molten metal thus delivered to the nip 27 forms a pool 30 above the nip and this pool is confined at the ends of the rolls by a pair of side closure dams or plates 28 which are applied to the ends of the rolls by a pair of thrusters (not shown) comprising hydraulic cylinder units connected to the side plate holders. The upper surface of pool 30 (generally referred to as the "meniscus" level) may rise above the lower end of the delivery nozzle so that the lower end of the delivery nozzle is immersed within this pool.

Casting rolls 22 are water cooled so that shells solidify on the moving roll surfaces and are brought together at the nip 27 between them to produce the solidified strip 12 which is delivered downwardly from the nip between the rolls.

At the start of a casting operation a short length of imperfect strip is produced as the casting conditions stabilise. After continuous casting is established, the casting rolls are moved apart slightly and then brought together again to cause this leading end of the strip to break away in the manner described in Australian Patent 646981 and U.S. Pat. No. 5,287,912 so as to form a clean head end of the following cast strip. The imperfect material drops into a scrap box 33 located beneath caster 11 and at this time a swinging apron 34 which normally hangs downwardly from a pivot 35 to one side of the caster outlet is swung across the caster outlet to guide the clean end of the cast strip onto the guide table 13 which feeds it to the pinch roll stand 14. Apron 34 is then retracted back to its hanging position to allow the strip 12 to hang in a loop 36 beneath the caster before it passes to the guide table 13. The guide table comprises a series of strip support rolls 41 to support the strip before it passes to the pinch roll stand 14 and a series of table segments 42, 43 disposed between the support rolls. The rolls 41 are disposed in an array which extends back from the pinch roll stand 14 toward the caster and curves downwardly at its end remote from the pinch rolls so as smoothly to receive and guide the strip from the loop 36.

The twin roll caster may be of the kind which is illustrated and described in some detail in U.S. Pat. Nos. 5,184,668 and 5,277,243 or U.S. Pat. No. 5,488,988 and reference may be made to those patents for appropriate constructional details which form no part of the present invention.

In order to control the formation of scale on the hot strip the installation is manufactured and assembled to form a very large enclosure denoted generally as 37 defining a sealed space 38 within which the steel strip 12 is confined throughout a transit path from the nip between the casting rolls to the entry nip 39 of the pinch roll stand 14. Enclosure 37 is formed by a number of separate wall sections which fit together at various seal connections to form a continuous enclosure wall. The function and detailed construction of enclosure 37 is fully described in Australian Patent 704312 and U.S. Pat. Nos. 5,762,136 and 5,960,855.

Pinch roll stand 14 comprises a pair of pinch rolls 50 which resist the tension applied by the reduction roll stand 16. Accordingly the strip is able to hang in the loop 36 as it passes from the casting rolls 22 to the guide table 13 and into the pinch roll stand 14. The pinch rolls 50 thus provide a tension barrier between the freely hanging loop and the tensioned downstream part of the processing line. They are also intended to stabilise the position of the strip on the feed table and feed it in to the rolling mill 16. However, it has been found in practice that there is a strong tendency for the strip to wander laterally on the guide table. If left unchecked the wandering movement of the strip can produce distortions in the shape of the loop with the consequent generation of waviness and cracks in the strip margins and in extreme cases complete disruption of the strip by massive transverse cracking.

It has been found that both the pinch rolls and the rolling mill contribute to wandering movements of the strip. In accordance with the present invention, both the pinch rolls and the rolling mill are operated to produce steering effects which counteract wandering movements in the strip. Specifically, both the pinch rolls and the reduction rolls have forces applied at positions spaced apart longitudinally across the rolls and the forces are varied relative to one another to produce the necessary steering effects on the strip. Accordingly the pinch roll stand 14 is operated as a strip steering device for steering the strip as it is fed toward the rolling mill and the rolling mill is also operated to further steer the strip as it passes through the mill.

The steering effects at the pinch rolls can be produced in various ways. When a strip is gripped between a pair of rolls at spaced locations and the gripping pressure at the two locations are changed relative to one another, the strip will be caused to skew relative to forward direction of travel which in turn causes the whole strip to move to one side. There are different mechanisms by which this skewing and lateral movement can be generated. If the rolls are concave, the strip will be gripped at two locations near the edges of the strip. If the strip is gripped more tightly toward one side than at the other there will be slippage at the more loosely gripped side causing the strip to skew. If the rolls are convex, changing the relative pressures at the two spaced locations will cause relative tilting between the rolls to change the position of the effective contact point between them which will also cause the strip to skew. A third mechanism for skewing is due to general or localised reduction or thinning of the strip at the side where greater pressure is applied which causes the strip to curve and skew. At the pinch rolls 14 in the illustrated continuous strip caster all three strip steering mechanisms may occur at differing times in the process. As the rolls heat up, they can distort which can change the manner in which the rolls grip the strip. Moreover, the strip profile can also change either between casts or throughout a cast and this will also change the kind of contact with the strip and the mode of gripping. However, in most instances, applying more gripping pressure to one side of the rolls will cause the strip to skew and move away from the side on which greater pressure is applied. In operation of the rolling mill 16, steering effects are generated primarily by reduction or thinning of the strip toward the side where greater pressure is applied causing the strip to curve and to skew away from the side of greater pressure.

Figure 4:
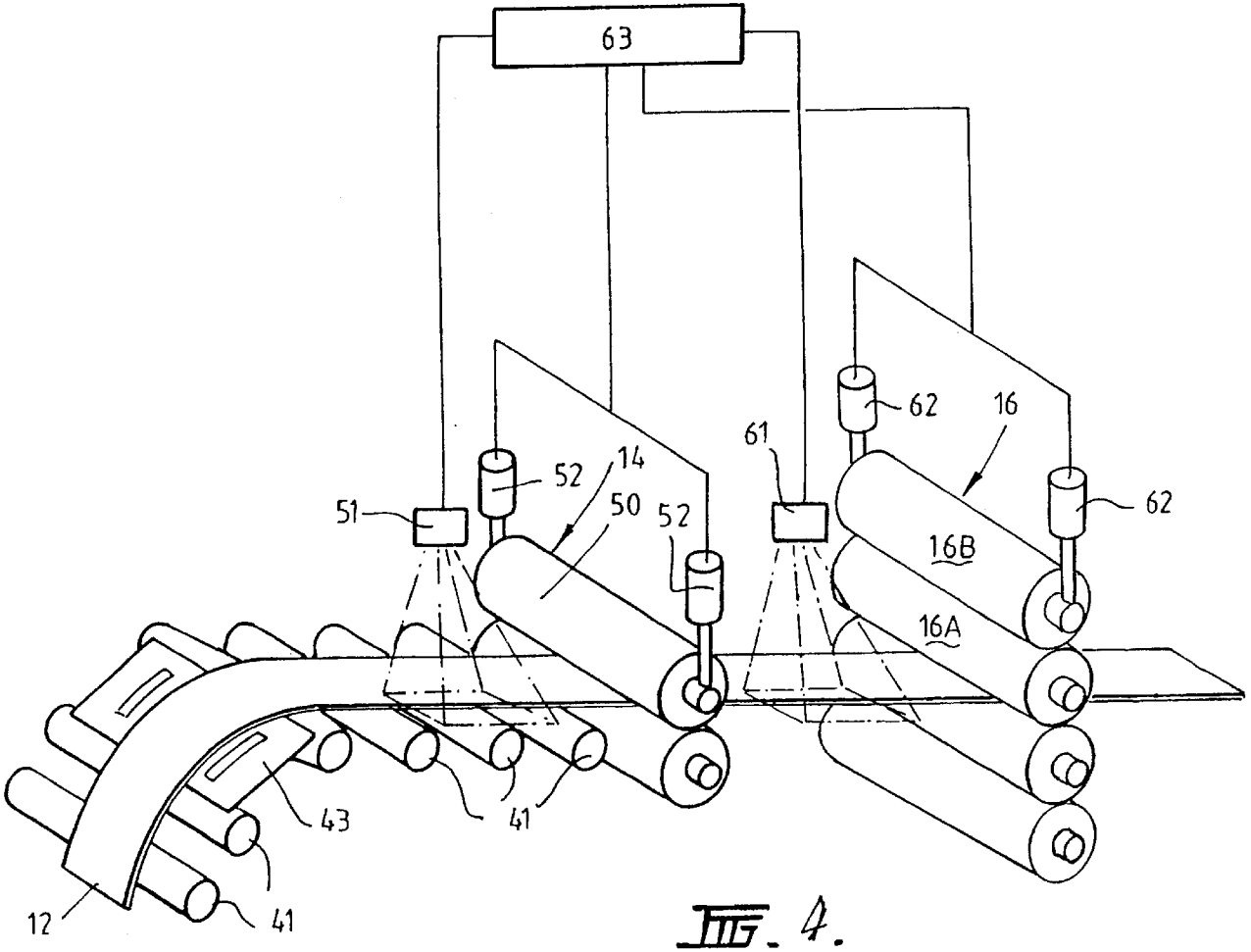
FIG. 4 diagrammatically illustrates the strip steering and rolling mill section of the installation.

As illustrated in FIG. 4, strip gripping forces are applied to pinch rolls 50 by means of two hydraulic cylinder units 52 located at the ends of the pinch rolls and independently operable so as to vary the pressures applied at the two sides of the roll and the reduction mill 16 is similarly provided with a pair of hydraulic cylinder units 62 which are independently operable so as to vary the pressure applied by the reduction rolls 16A across the strip. In this way the strip can be steered both by operation of the pinch rolls 50 and the reduction rolls 16A.

In order to generate control signals to control the pressure differentials applied to the pinch rolls 50 and the reduction rolls 16A so as to control steering of the strip, the position of the strip is monitored at a first location in the vicinity of the pinch rolls by a strip position sensor 51 which senses the lateral position of the strip on the guide table and also at a second location in the vicinity of reduction rolls 16A by a strip position sensor 61 which senses the lateral position of the strip immediately in advance of the reduction rolls 16A. In this way, the lateral position of the strip is monitored at two locations immediately in advance of the pinch rolls 50 and immediately in advance of the reduction rolls 16A. In a modified arrangement the strip sensors 51 and 61 may be replaced by a multiplicity of sensors at both locations in advance of the pinch rolls and in advance of the mill to enable the skew angle of the strip to be determined at each location as an alternative or in addition to the determination of the strip position.

The output of sensors 51 and 61 is fed to a controller 63 which generates control signals to control the operation of both sets of hydraulic cylinder units 52 and 62.

Figure 5:
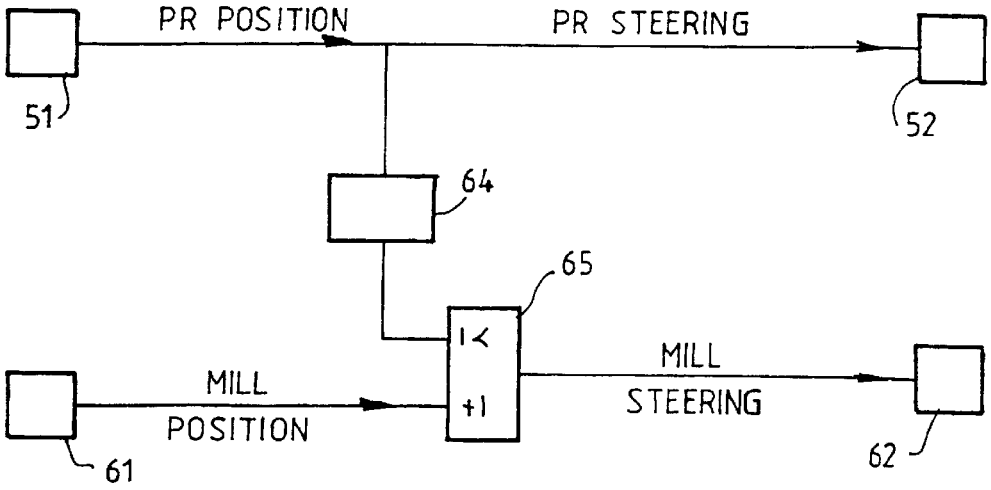
FIG. 5 is a circuit diagram of one form of control device to control operation of steering pinch rolls and reduction rolls.

FIG. 5 illustrates one form of control circuit for the controller 63. With this control circuit the position of the strip in advance of the pinch rolls 50 as sensed by sensor 51 produces a control signal for the pinch roll hydraulic cylinder units 52 tending to move the strip back to a set position.

The signal from sensor 51 is also fed through a lagging or delay device 64 to produce a time delayed signal which is fed to a comparator 65 which compares the delayed signal with the signal produced by the sensor 61 indicating the position of the strip at the entry to the reduction rolls 16A. The lag of device 64 is equal to the time taken for the strip to travel from the first location observed by sensor 51 to the second location observed by sensor 61 and the comparison therefore measures lateral movement of the strip between those two locations. The comparator 64 applies a factor k to the delayed signal to be compared with the mill signal. If the factor k is set at −1, the mill would only be operated to steer the strip if there has been lateral movement of the strip between the first and second locations. This provides effective decoupling between the pinch roll steering and the mill steering effect. If the factor k is set at 0 there will be full mill steering and the circuit will produce control signals for the mill which ignore any corrective action already taken by the pinch roll control. It has been found in practice that in order to deal with all possible kinds of wandering movements of the strip, partial decoupling of the two controls provides the best results and in order to provide this the factor k may be set at −0.5.

Figure 6:
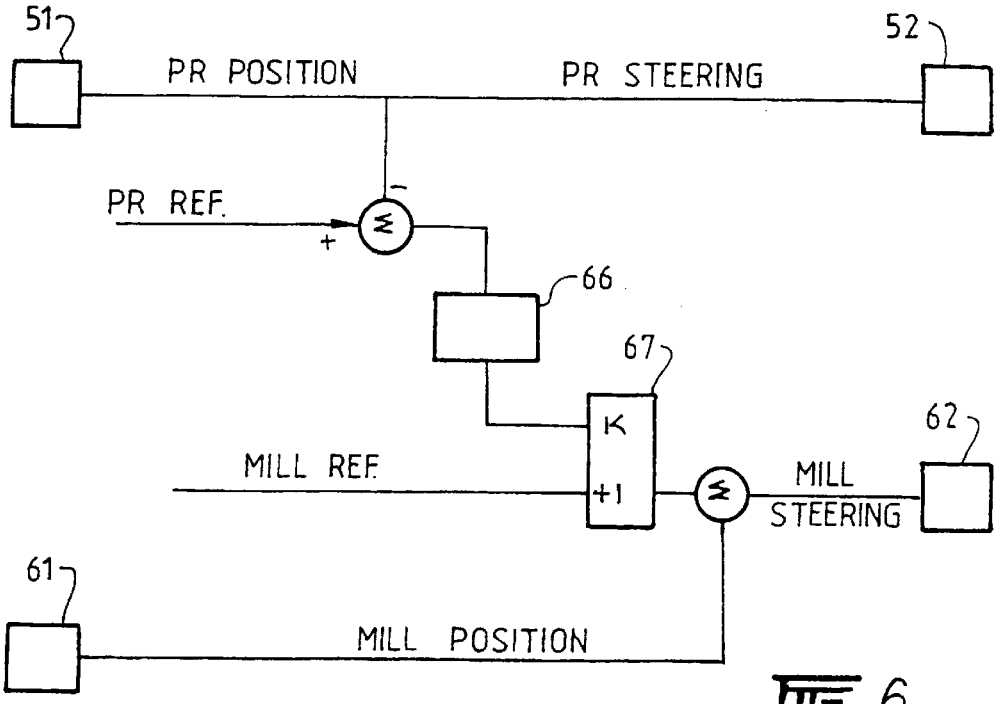
FIG. 6 is a circuit diagram of an improved form of control device for controlling operation of the steering pinch rolls and reduction rolls.

FIG. 6 illustrates a presently preferred control circuit for the controller 63. In this circuit, the signal produced by sensor 51 indicative of the lateral position of the strip in advance of the pinch rolls is compared with a pinch roll desired or reference position to produce an error signal which is fed through the lagging device 66 to produce a time delayed error signal. That time delayed error signal is fed to comparator 67 together with a mill reference position to produce an output which is compared with the observed position of the strip in advance of the mill by the sensor 61 in order to produce a control signal for the hydraulic cylinder units 62. If the strip is at the reference position or set point in advance of the pinch rolls, the error signal will be 0. If the mill reference position or set point is 0 there will be no control signal to the mill. Accordingly, the system only operates to cause mill steering if the pinch rolls are in a dynamic state. With this arrangement, it is possible to achieve integral control of the mill so that the mill can operate to move the strip back to a set point while avoiding dynamic interaction between the pinch rolls and the mill.

The illustrated apparatus has been advanced by way of example only and it could be modified considerably. For example, there are known strip guidance devices incorporating a pair of pinch rolls which can be swung laterally of the strip about an offset pivot guide or virtual pivot point in order to steer the strip. It would be possible to incorporate such a pivoting steering device to provide the necessary pinch roll steering in advance of the rolling mill, the strip position signal produced by the sensor 51 being used to control pivoting movements of the strip guiding pinch rolls instead of controlling the gripping pressure applied by those rolls. Moreover, although the invention is particularly useful in controlling and steering strip being produced in a continuous strip caster and subjected to in-line rolling, the invention can be applied in any installation in which strip material is to be fed through reduction roll

What is claimed is:

1. A method of rolling strip material comprising passing the strip through a steering device into a rolling mill having a pair of strip reduction rolls extending laterally of the strip feed direction, the steering device being operable to steer the strip as it passes to the rolling mill, applying strip reduction squeezing forces to the reduction rolls at positions spaced apart longitudinally across those rolls monitoring the position of the strip at a first location in the vicinity of the steering device and at a second location in the vicinity of the rolling mill, and operating the steeling device and varying the relative squeezing forces on the reduction rolls at the spaced positions in response to observed positions of the strip at said first and second locations.

2. The method as claimed in claim 1, wherein the steering device is operated in response to the observed position of the strip at said first location.

3. The method as claimed in claim 1, wherein variation of the relative squeezing forces applied to the reduction rolls is dependent on observed positions of the strips at both said first and second locations.

4. The method as claimed in claim 3, comprising generating a first control signal dependent on the observed strip position at said first location, generating a second control signal dependent on the observed strip position at said second location, operating the steeling device to steer the strip in response to the first control signal, applying a time lag to the first control signal corresponding to a function of the time of strip travel between said first and second locations, making a comparison between the lagged first control signal and the second control signal, and varying the relative squeezing forces on the reduction rolls at the spaced positions in response to the outcome of that comparison.

5. The method as claimed in claim 4, wherein the second control signal is generated from a comparison of the observed strip position at said second location with a desired or set position for that location.

6. The method as claimed in claim 1, wherein the steering device is operated in response to a control signal produced by comparing the observed position of the strip at said first location with a desired or set position.

7. The method as claimed in claim 6, wherein variation of the relative squeezing forces applied to the reduction rolls is controlled by a further control signal dependent on observed strip positions at both said first and second locations when compared with desired or set positions at those locations to effect a change in the strip position and/or skew of the strip at the mill.

8. The method as claimed in claim 1, wherein said first location is in advance of the steering device in relation to the snip feed direction and said second location is in advance of the reduction rolls.

9. The method as claimed in claim 1, wherein the steering device comprises a pair of pinch rolls extending laterally of the strip feed direction.

10. The method as claimed in claim 9, wherein the strip is passed between the pinch rolls and the steering device is operated by applying strip gripping forces to the pinch rolls at positions spaced apart along the pinch rolls and varying the relative strip gripping forces at those positions thereby to steer the strip.

11. An apparatus for rolling strip material, having a pair of reduction rolls to receive the strip material;

a roll thruster to apply squeezing forces to the reduction rolls at positions spaced apart along those rolls;

a strip steering device to steer the strip to the reduction rolls and operable to vary the feed direction;

a first strip position sensor to monitor the position of the strip at a first location in the vicinity of the strip steering device;

a second strip position sensor to monitor the position of the strip at a second location in the vicinity of the reduction rolls; and a controller responsive to outputs of the first and second strip position sensors to operate the steering device to vary the direction of feed to the reduction rolls and also to vary the relative squeezing forces applied to the reduction rolls at the spaced apart positions.

12. The apparatus as claimed in claim 11, wherein the controller is operable to vary the relative squeezing forces applied to the reduction rolls at the spaced apart position so as to vary the position and skew of the strip entering the reduction rolls.

13. The apparatus as claimed in claim 11, wherein the controller operates the steering device in response to the instantaneous position of the strip at said first location.

14. The apparatus as claimed in claim 11, wherein the controller operates to vary the relative squeezing forces applied to the reduction rolls in response to the instantaneous positions of the strip at both said first and second locations.

15. The apparatus as claim 11, wherein the control means is effective to produce a strip steering device control signal by comparison of the position of the strip at said first location with a desired or set location.

16. The apparatus as claimed in claim 15, wherein the controller is operable to vary the relative squeezing forces applied to the reduction rolls by generating a further control signal dependent on the strip position at both said first and second locations when compared with desired or set positions for those locations.

17. The apparatus as claimed in claim 11, wherein said first location is in advance of the steering device in relation to the strip teed direction and said second location is in advance of the reduction rolls.

18. The apparatus claimed in claim 11, wherein the steering device comprises a pair of pinch rolls extending laterally of the strip feed direction.

19. The apparatus as claimed in claim 18, wherein the controller is effective to operate the steering device by application of strip gripping forces to the pinch rolls at positions spaced apart along the pinch rolls and variation of the relative strip gripping forces at those positions thereby to steer the strip.

* * * * *